US005984087A

United States Patent [19]

Hacikyan

[11] Patent Number: 5,984,087

[45] Date of Patent: Nov. 16, 1999

[54] VIAL CONTAINER

[75] Inventor: Mike Hacikyan, Buffalo, N.Y.

[73] Assignee: Technicor, Inc., Buffalo, N.Y.

[21] Appl. No.: 09/247,421

[22] Filed: Feb. 10, 1999

[51] Int. Cl.[6] ..... B65D 65/46

[52] U.S. Cl. ..... 206/204; 206/524.7

[58] Field of Search ..... 206/204, 484, 206/484.2, 524.7; 383/109, 113

[56] References Cited

U.S. PATENT DOCUMENTS

| | | | |
|---|---|---|---|
| 3,990,872 | 11/1976 | Cullen | 55/274 |
| 4,748,069 | 5/1988 | Cullen | 428/195 |
| 4,853,266 | 8/1989 | Cullen | 421/35.7 |
| 5,069,694 | 12/1991 | Cullen et al. | 55/318 |
| 5,279,421 | 1/1994 | Gouge et al. | 206/484 |
| 5,284,621 | 2/1994 | Kaufman | 422/32 |
| 5,330,047 | 7/1994 | Gouge et al. | 206/205 |
| 5,403,096 | 4/1995 | Aagesen | 206/524.7 X |
| 5,691,015 | 11/1997 | Tsukamoto et al. | 428/35.2 |
| 5,697,200 | 12/1997 | Insley et al. | 206/204 X |
| 5,827,586 | 10/1998 | Yamashita et al. | 428/36.6 |

*Primary Examiner*—Jacob K. Ackun
*Attorney, Agent, or Firm*—Hodgson, Russ, Andrews, Woods & Goodyear, LLP

[57] ABSTRACT

The present invention relates to a packaging container designed to transport an inner container containing a liquid. The packaging container has at least one sealing multi-layer comprising a first water soluble film and an absorbent material. The inner layer of the packaging container is the water-soluble film that forms the boundary between the cavity that hold the inner container and the packaging container. When the liquid leaks from the inner container while in the packaging container, the liquid dissolves the water-soluble film. When the film is dissolved, the absorbent material is released to absorb and immobilize the liquid material. This immobilization prevents the liquid from escaping from the packaging container.

25 Claims, 3 Drawing Sheets

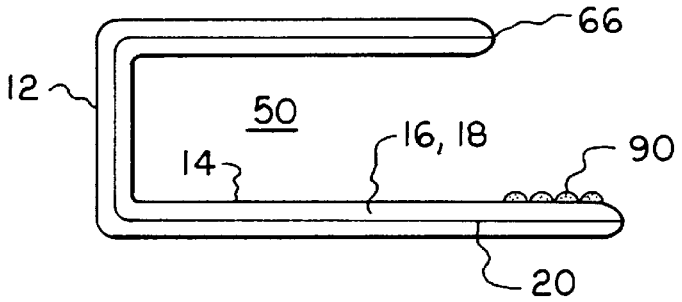
FIG. 4
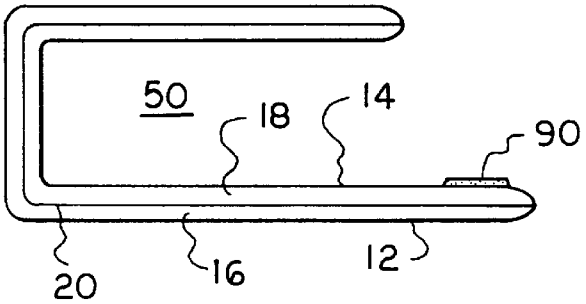
FIG. 5
FIG. 6
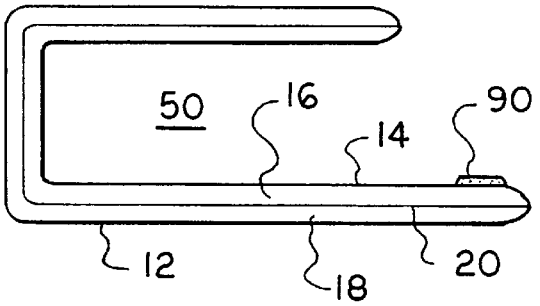
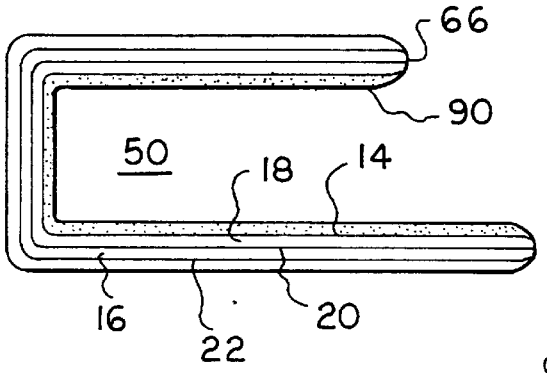
FIG. 7
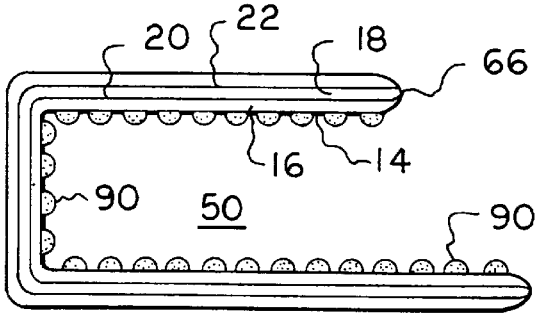
FIG. 8

VIAL CONTAINER

FIELD OF THE INVENTION

The present invention is a packaging container that holds a liquid contained within an inner container. And when the material leaks from the inner container, the package container ensures the material does not leak therefrom.

BACKGROUND OF THE INVENTION

Prior attempts to control leaking materials have been disclosed in U.S. Pat. No. 4,749,600 (Inventors: Cullen et al.). Cullen et al. disclose a packet for absorbing and immobilizing a liquid. The packet looks like a sugar packet (See FIG. 3 of the '600 patent) by having an outer layer and inner contents. When the packet is to be used, it is inserted within an outer container, like a Federal Express package. In most instances, the packet falls to the bottom edge, in particular a corner, of the outer container. See Col. 2, lines 46 of the '600 patent. Along with the packet, an inner container of a liquid, like a test-tube of blood (See FIG. 5 of the '600 patent) is inserted into the outer container. According to the '600 patent, the bottom edge of the inner container should contact the packet. Thus, when the blood spills from the inner container, the blood may contact the packet.

If the blood contacts the packet, the blood dissolves the outer layer. The packet has an inner layer of polyvinyl acetate and an outer layer of starch paper or any other liquid-degradable material. The polyvinyl acetate has to be the inner layer in order for the packet to be formed. See col 2, lines 9–11 of the '600 patent.

When the outer layer dissolves, the inner contents are released and form a gel-like substance by absorbing the blood. The inner content is sodium polyacrylate having the formula $(C_3H_3O_2Na)_n$. It is obtainable under the trademark WATER LOCK J-550 from Grain Processing Corporation.

A problem with the Cullen et al. attempt to immobilize a liquid, is that the packet is so small that it is possible that the liquid may never contact the packet. For example, if the packet is located at the bottom of the outer container, as Cullen et al. suggest, and the liquid leaks to the top of the outer container, the packet will never immobilize the liquid since the liquid never contacts the packet. Thereby, the liquid spills from the outer container and provides little protection to the handler of the package. These results could be extremely deleterious to the handler. For example, if the liquid is HIV contaminated and that liquid contacts a cut on the handler, that handler could become infected. This problem is solved by the present invention.

SUMMARY OF THE INVENTION

The present invention relates to a packaging container designed to transport an inner container containing a liquid. The packaging container has at least one sealing multi-layer comprising a first water soluble film and an absorbent material. The inner layer of the packaging container is the water-soluble film that forms the boundary between the cavity that hold the inner container and the packaging container. When the liquid leaks from the inner container while in the packaging container, the liquid dissolves the water-soluble film. When the film is dissolved, the absorbent material is released to absorb and immobilize the liquid material. This immobilization prevents the liquid from escaping from the packaging container.

BRIEF DESCRIPTION OF THE DRAWINGS

FIGS. 3 to 9 are alternative embodiments of FIG. 2.

DETAILED DESCRIPTION OF THE PRESENT INVENTION

Figure 1:
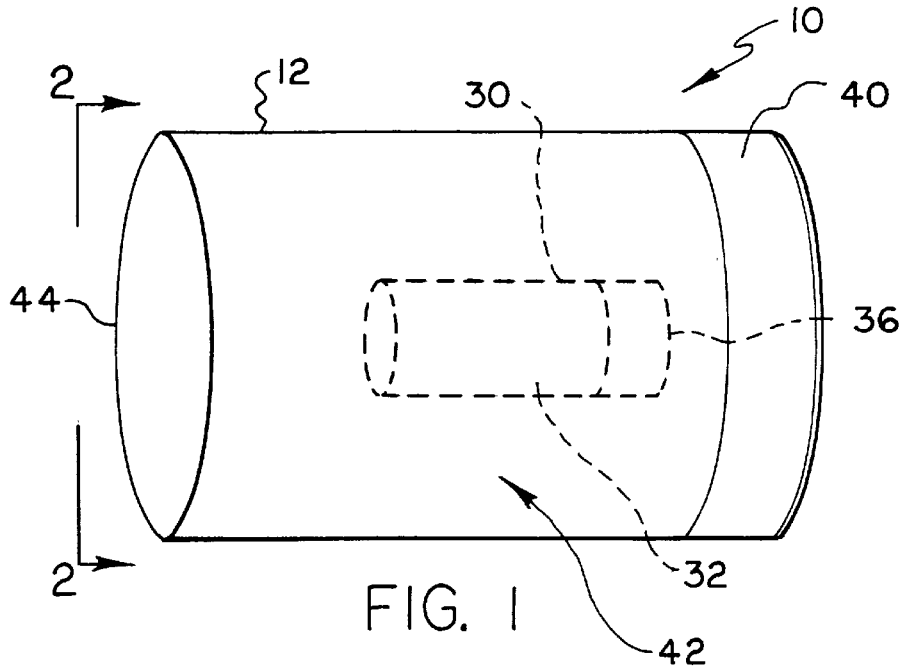
FIG. 1 is a perspective view of the packaging container.

One version of the packaging container 10 for adsorbing and immobilizing a liquid 32 is shown at FIG. 1. The container 10 includes a multi-layer film wherein the outer layer 12 is shown. The outer layer 12 is any suitable material such as paper, cardboard, wood, or plastic, but preferably a water-insoluble material. Examples of some water-insoluble materials that can be used for the outer layer 12 include thermoplastic resin films, laminated films prepared from two or more thermoplastic resin films, and laminated films prepared from a thermoplastic resin film and paper, metallic foil, woven fabric or unwoven fabric. Preferable thermoplastic resins include polymers and copolymers of olefins, such as ethylene, propylene, butene, pentene, hexene, and the like; polymers and copolymers of vinyl compounds such as vinyl chloride, vinylidene chloride, vinylacetate, vinyl alcohol, acrylic ester, methacrylic ester, acrylonitrile, styrene and the like, polymers of diolefins such as butadiene, isoprene, and the like; copolymers of the above-mentioned olefins, or vinyl compounds; polyamides; and polyesters such as polyethylene terephthalate and the like.

Figure 2:
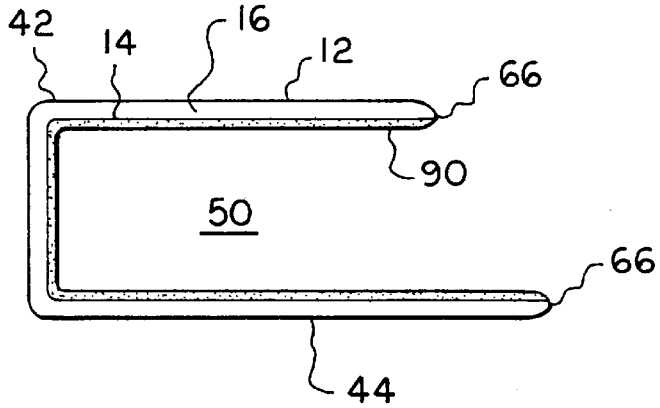
FIG. 2 is a cross-sectional view of FIG. 1 taken along the line 2—2.
Figure 3:
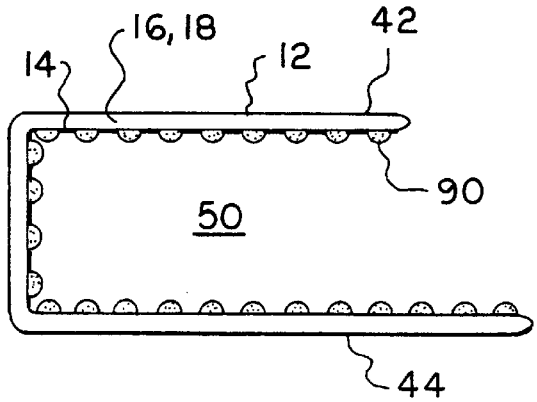

The container 10 has at least two sides—a top side 42 and a bottom side 44. The bottom side 44 is longer than the top side 42 because the bottom side 44 has a flap 40. The flap 40 is designed to fold over onto a portion of the top side 42, as shown in FIG. 1. The inner layer of the flap 40 that contacts the top side 42 has a conventional sealant material 90, as shown in FIGS. 2–9. Such sealant materials 90 include polyvinyl acetate, ethylvinyl acetate or glue. These sealant materials 90 can be film-like as shown in FIGS. 5–9 or a dot matric coating as shown in FIGS. 2–4. In either case, these sealant materials 90 adhere to the top side 42 by conventional sealing processes, such as crimping, adhesive or heat sealing to ensure the package 10 is tamper resistant.

The packaging container 10 is used to transport liquids or gelatin materials, hereinafter liquid material 32, from one place to another. The liquid material 32 can be biological, radioactive, a pesticide, and/or a chemical agent.

A vial 30 contains the liquid 32. The vial 30 is any type of container that can securely hold the liquid material 32 and fit within the container 10. The vial 30 can be any suitable material, such as glass, metallic, ceramic or plastic. The vial 30 includes a cap 36 which holds the liquid 32 sealed within the vial 30. Sometimes, the liquid 32 leaks from the vial 30. When this occurs, the inner layer of the container 10 controls the leaking.

Turning to FIG. 2, the container 10 has the outer layer 12, a cavity 50 to hold the vial 30, an absorbent material 16, and a first layer of a water-soluble material 14. The layers 12 and 14 are superimposed upon each other and seal together at the peripheral edges 66 of the container 10. At the peripheral edges 66, the layers 12, 14 are sealed together by conventional methods, such as heat sealing, crimping and/or adhesive. Between layers 12, 14 is the absorbent material 16. The absorbent material 16 is contained within the two layers 12, 14 until the first layer 14 dissolves.

The first layer 14 is any conventional water soluble material, such as starch paper, polyvinyl acetate, water-soluble synthetic polymer films, water soluble semisynthetic polymer films, and water-soluble natural polymers.

Examples of water soluble synthetic polymer films include partially saponified polyvinyl alcohol, polyethers, such as polyethylene oxide and the like, polyvinylpyrrolidone, ethylenically unsaturated acids, such as acrylic acid, methacrylic acid, maleic acid, and polymers formed from their salts thereof.

Examples of water soluble semisynthetic polymer films include cellulose derivatives, such as carboxymethyl cellulose, hydroxyethyl cellulose, hydroxypropyl cellulose, and starch derivatives such as cyclodextrin. As for the water-soluble natural polymers, those include carrageena, starch, gelatin, and chitin.

In any case, the inner layer 14 dissolves when a liquid, preferably liquid 32, contacts it. The absorbent material 16 is then released. When released, the material 16 absorbs or immobilizes large volumes of aqueous solutions including dilute alkalis, dilute acids and body fluids. The material is sodium polyacrylate having the formula $(C_3H_3O_2Na)_n$. It is obtainable under the trademark WATER LOCK J-550 from Grain Processing Corporation.

In some instances, it is desirable to add a conventional nullifying agent 18, such as a biocide or equivalent thereof, to nullify a specific undesirable quality of the liquid 32. In some instances, it is desirable to mix the absorbent material 16 and nullifying agent 18 together as shown in FIG. 3.

In another embodiment of the present invention, a second water soluble film 20 is located between the first layer 14 and the outer layer 12. The second layer 20 is selected from the same group of materials as the first layer 14. Moreover, the first layer 14 superimposes upon the second layer 20 and the outer layer 12, wherein each layer 12, 14, 20 seals together at the peripheral edges 66. As shown in FIG. 4, the absorbent material 16 and nullifying agent 18 are mixed together between the first and second layers 14, 20, or alternatively, either the absorbent material 16 or the nullifying agent 18 are between the first and second layers 14,20.

To ensure safe transport of the liquid 32, sometimes it is advisable to separate the two materials 16, 18. In FIG. 5, the nullifying agent 18 is between the first layer 14 and the second layer 16 while the absorbent material 16 is between the second layer 16 and the outer layer 12. In contrast, FIG. 6 shows the opposite configuration of FIG. 5.

In yet another embodiment of the present invention, FIGS. 7 and 8 illustrate a variation of FIGS. 5 and 6 respectively. The only difference between these figures is that FIGS. 7 and 8 both illustrate a third water soluble film 22. The third layer 22 is selected from the same group of materials as the first layer 14. Moreover, the first layer 14 superimposes upon the second layer 20, third layer 22, and outer layer 12, wherein each layer 12, 14, 22, 20 seals together at the peripheral edges 66.

Figure 9:
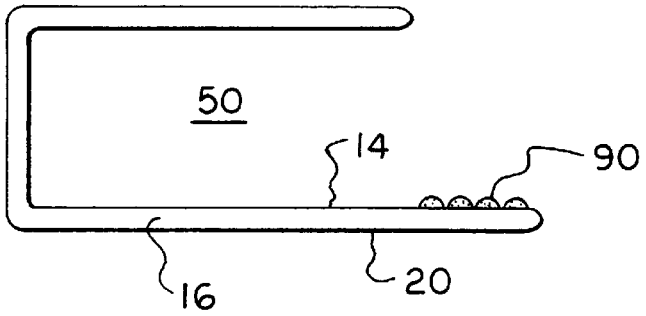
Figure 10:
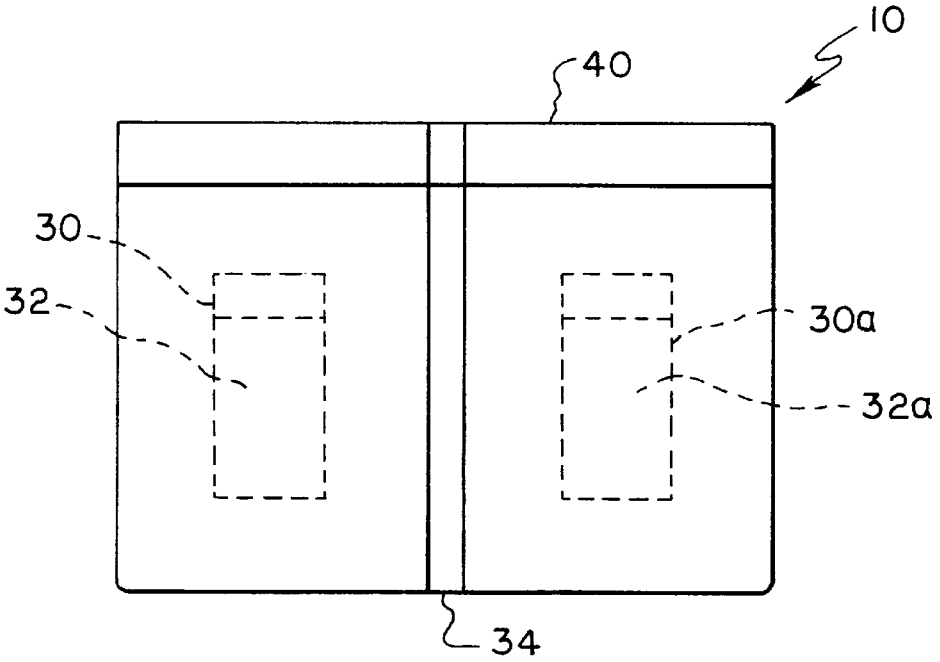
FIG. 10 is an alternative embodiment of FIG. 1.

Another embodiment of the present invention is illustrated in FIG. 9. FIG. 9 illustrates FIG. 4 without the water insoluble layer 22. Obviously, as indicated by FIG. 9, alternative embodiments of the present invention also include those embodiments shown in FIGS. 4–8 without the water insoluble layer 22.

In yet another embodiment of the present invention, the package container 10 can be divided into having at least two cavities 50, 50*a* to hold two vials 30, 30*a*. The container 10 is divided, not always equally, along edge 34. Edge 34 is formed in the same manner as the various layers of container 10 are joined at peripheral edge 66.

The present invention ensures that if for any reason liquid 32 leaks from vial 30, the liquid 32 will dissolve at least a portion of the first layer 14 because the first layer 14, and obviously the absorbent material 16 and/or nullifying agent 18, completely surrounds the vial 30. And once the first layer 14 is dissolved, the enclosed agent, either 16 and/or 18, will nullify or absorb the liquid 32. Thereby, the handler of the packaging container 10 will know that no liquid 32 will accidently leak from it.

While preferred embodiments of the present invention have been disclosed, it will be appreciated that it is not limited thereto but may be otherwise embodied with the scope of the following claims.

I claim:

1. A packaging container comprising at least one sealable multi-layer film having at least a first layer of a water soluble film and at least one layer of a water insoluble film, wherein the inner layer of the packaging container is the water soluble film and the outer layer of the packaging container is the water insoluble film, the water insoluble film and water soluble film are superimposed and bonded to each other at the peripheral edges of each film, the water soluble film dissolves when a liquid material contained in a vial leaks within the packaging container;

a cavity within the packaging container to hold the vial wherein the boundary between the cavity and the packaging container is the first water soluble film; and an absorbent material between the first water soluble film and the water insoluble film that absorbs and immobilizes the liquid material, so the liquid material is prevented from leaking from the packaging container.

2. The packaging container of claim 1 further comprising a second water soluble film superimposed between the first water soluble film and water insoluble film and bonded at the peripheral edges of each film.

3. The packaging container of claim 1 further comprising a nullifying material for additionally treating the liquid material to nullify a specific undesirable quality thereof.

4. The packaging container of claim 3 wherein the nullifying material is mixed with the absorbent material.

5. The packaging container of claim 2 further comprising a nullifying material for additionally treating the liquid material to nullify a specific undesirable quality thereof, the nullifying material is between the first and second water soluble films, and the absorbent material is between the second water soluble film and the water insoluble film.

6. The packaging container of claim 2 further comprising a nullifying material for additionally treating the liquid material to nullify a specific undesirable quality thereof, the nullifying material is between the second water soluble film and the water insoluble film, and the absorbent material is between the first and second water soluble films.

7. The packaging container of claim 2 comprising a third water soluble film superimposed between the second water soluble film and water insoluble film and bonded at the peripheral edges of each film.

8. The packaging container of claim 7 wherein the absorbent material is between the second and third soluble films.

9. The packaging container of claim 7 wherein the absorbent material is between the first and second soluble films.

10. The packaging container of claim 1 wherein the container is tamper-resistant.

11. The packaging container of claim 1 wherein the inner layer of the first water soluble layer has a sealant material.

12. The packaging container of claim 2 wherein the inner layer of the second water soluble layer has a sealant material.

13. The packaging container of claim 7 wherein the inner layer of the third water soluble layer has a sealant material.

14. A packaging container comprising at least one sealable multi-layer film having at least a first layer of a water soluble film and a second layer of a water soluble film, wherein the inner layer of the packaging container is the first water soluble film and the outer layer of the packaging container is the second water soluble film, the first and second water soluble films are superimposed and bonded to each other at the peripheral edges of each film, each water soluble film dissolves when a liquid material contained in a vial leaks within the packaging container;

a cavity within the packaging container to hold the vial wherein the boundary between the cavity and the packaging container is the first water soluble film; and an absorbent material between the first and second water soluble films that absorbs and immobilizes the liquid material, so the liquid material is prevented from leaking from the packaging container.

15. The packaging container of claim 14 further comprising a water insoluble film that encloses the container, the container becomes tamper-resistant.

16. The packaging container of claim 14 further comprising a nullifying material for additionally treating the liquid material to nullify a specific undesirable quality thereof.

17. The packaging container of claim 16 wherein the nullifying material is mixed with the absorbent material.

18. The packaging container of claim 14 comprising a third water soluble film superimposed between the first and second water soluble films and bonded at the peripheral edges of each film.

19. The packaging container of claim 18 further comprising a nullifying material for additionally treating the liquid material to nullify a specific undesirable quality thereof, the nullifying material is between the first and third water soluble films, and the absorbent material is between the third and second water soluble films.

20. The packaging container of claim 18 further comprising a nullifying material for additionally treating the liquid material to nullify a specific undesirable quality thereof, the nullifying material is between the second and third water soluble films, and the absorbent material is between the third and first water soluble films.

21. The packaging container of claim 18 wherein the absorbent material is between the second and third soluble films.

22. The packaging container of claim 18 wherein the absorbent material is between the first and third soluble films.

23. The packaging container of claim 14 wherein the inner layer of the first water soluble layer has a sealant material.

24. The packaging container of claim 14 wherein the inner layer of the second water soluble layer has a sealant material.

25. The packaging container of claim 18 wherein the inner layer of the third water soluble layer has a sealant material.

* * * * *